United States Patent [19]

Rosenbaum

[11] Patent Number: 4,459,828

[45] Date of Patent: Jul. 17, 1984

[54] MULTIPLE-CHAMBER COOLING DEVICE PARTICULARLY USEFUL IN A DILUTION REFRIGERATOR

[76] Inventor: Ralph L. Rosenbaum, 17 Hashalom St., Raanana, Israel

[21] Appl. No.: 334,180

[22] Filed: Dec. 24, 1981

[30] Foreign Application Priority Data

Aug. 6, 1981 [IL] Israel ..... 63517

[51] Int. Cl.[3] ..... F25B 19/00

[52] U.S. Cl. ..... 62/514 R; 165/111

[58] Field of Search ..... 62/514 R, 52; 165/111, 165/112, 113

[56] References Cited

U.S. PATENT DOCUMENTS 3,835,662 9/1974 Staas et al. ..... 62/514 R 4,134,037 1/1979 Berthet ..... 62/514 R

*Primary Examiner*—Ronald C. Capossela

*Attorney, Agent, or Firm*—Benjamin J. Barish

[57] ABSTRACT

A multiple-chamber cooling device particularly useful in a dilution refrigerator in which a working liquid is passed successively through a plurality of chambers in each of which a fraction of the working liquid is allowed to evaporate to cool the remaining working liquid. The cooling device comprises a common body member of low thermal conductivity formed with a plurality of spaced bores each defining one of the chambers, the outlet end of each chamber bore being connected by a passageway to the inlet end of the adjacent bore for passing the working liquid from one to the next chamber bore as a fraction of the working liquid is evaporated to cool the remainder.

12 Claims, 11 Drawing Figures

TRIPLE MIXING CHAMBER

| Z | $\times 10^6$ ($cm^{-3}$) |
|---|---|
| $Z_1$ | 18 |
| $Z_2$ | 4 |
| $Z_{3A}$ | 0.08 |
| $Z_{3B}$ | 0.05 |

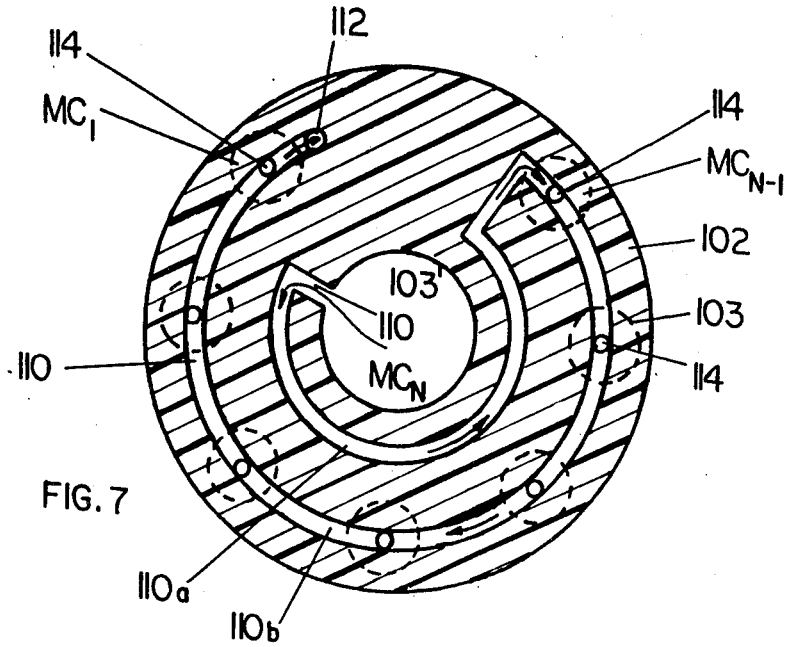
FIG. 7
FIG. 7
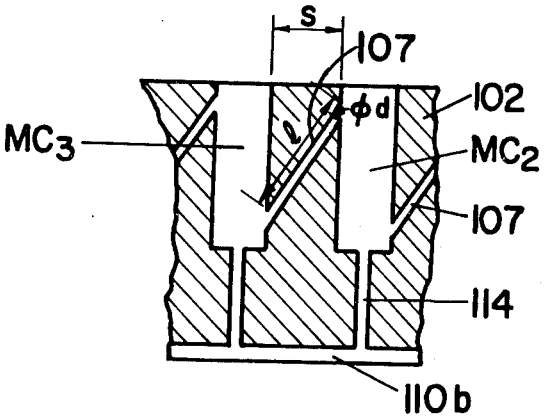
FIG. 8
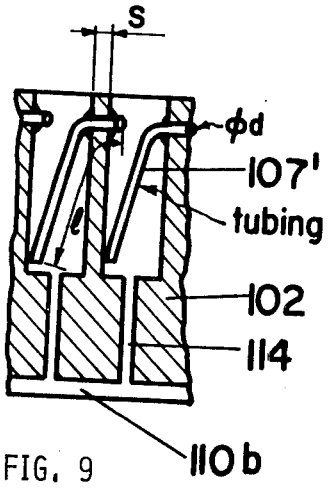
FIG. 9

MULTIPLE-CHAMBER COOLING DEVICE PARTICULARLY USEFUL IN A DILUTION REFRIGERATOR

BACKGROUND OF THE INVENTION

The present invention relates to a multiple-chamber cooling device in which a working liquid is passed successively through a plurality of chambers in each of which a fraction of the working liquid is allowed to evaporate to cool the remaining working liquid. The invention is particularly useful in dilution refrigerators for cooling samples to a temperature approaching absolute zero, and the invention is therefore described below with respect to this application.

In the dilution refrigerator described below as one implementation of the invention, the starting medium is a liquid mixture of the isotopes $He^3$ and $He^4$. At ultra-low temperatures, this liquid mixture separates into a $He^3$-rich phase (concentrated phase) of practically pure $He^3$, and a $He^4$- phase (dilute phase) of superfluid $He^4$ having somewhat over 6% $He^3$ dissolved therein. Because of the lower density, the $He^3$-rich (concentrated) phase flows on top of the $He^4$-rich (dilute) phase. Cooling is produced when the $He^3$ atoms cross the phase boundary from the concentrated (top) to the dilute (bottom) phase. Thus, the "cooling" is effected by "evaporation" of $He^3$ into superfluid $He^4$, similar in principle to an ordinary evaporation-type refrigerator in which the cooling is effected by evaporation of a liquid to a vapor.

The dilution refrigerator is routinely used to cool samples to 12 mK (one mK=0.001 K within absolute zero). The lowest temperature attainable is generally limited by the quality of the heat-exchangers, particularly because of the substantial thermal boundary resistance (known as the Kapitza boundary resistance) between the helium liquids and any solid. For this reason, such heat-exchangers usually include enormous surface area, e.g., of sintered silver particles, to reduce the Kapitza thermal resistance between the liquid and the metal body of the heat-exchanger.

It has been recently proposed to use a plurality of discrete mixing chambers in series-parallel configuration for this purpose. See, for example, the publications:

(1) De Waele, A. Th. A. M., Reekers A. B., and Gijsman, H. M., *Physics* 81*B*, (1976), 323.

(2) Reekers, A. B., *Een Mengkaeler met Meerdere Mengkamers* (Eindhoven University of Technology, Eindhoven, The Netherlands, 1977), unpublished Ph.D. thesis, 49.

(3) Coops, G., de Waele, A. Th. A. M. and Gijsman, H. M., *Cryogenics* 19 (1979), 659.

(4) De Waele, A. Th. A. M., Coops, G., and Gijsman, H. M., *Proc. 15th Lt Conf., J. de Physique Colloq C*-6, Vol. 11, 39 suppl 8 (1978), 1150.

The basic idea of the multiple-mixing chamber is as follows: Instead of evaporating all the $He^3$ liquid in a single mixing chamber, only a small fraction of the $He^3$ liquid is allowed to evaporate. This evaporation cools the remaining $He^3$ liquid to a lower temperature, typically resulting in a 10% to 30% reduction in the original temperature. Although the temperature reduction is relatively small, the amount of heat (or enthalpy) removed from the $He^3$ liquid is relatively great because of the dependence of the heat capacity upon the temperature. (This temperature-dependence of the $He^3$ specific heat is in contrast to the constant specific heat of most liquids used in conventional refrigerators.) The remaining $He^3$ liquid is routed to the second mixing chamber where, again, a fraction of this liquid is evaporated, thus cooling the remaining fraction. This process continues in the remaining mixing chambers until the cool $He^3$ liquid (what remains of the original $He^3$ liquid charge) enters the last mixing chamber where it is forced to evaporate entirely. In this last evaporation step, there is typically a reduction of about 2.0 to 2.5 in temperature; theory predicts a factor of 2.8. The big advantage of this process is that there is no Kapitza boundary resistance between the $He^3$ liquid and the "gas" (dilute $He^3$-$He^4$ solution liquid); thus, there is excellent thermal contact between the cold "gas" and warm $He^3$ liquid. The disadvantage is that a part or most of the original $He^3$ liquid charge is "used-up" during the intermediate cooling steps, leaving only a fraction of the original charge available for the final evaporation step. But by proper design, it is possible to have 30% to 50% of the original charge available for the final evaporation.

BRIEF SUMMARY OF THE INVENTION

According to a broad aspect of the present invention, there is provided a multiple-chamber cooling device particularly useful in a dilution refrigerator in which a working liquid is passed successively through a plurality of chambers in each of which a fraction of the working liquid is allowed to evaporate to cool the remaining working liquid, characterized in that the cooling device comprises a common body member of a material having low thermal conductivity at the operating temperature of the cooling device. The common body member is formed with a plurality of spaced bores each defining one of the chambers, the bore defining the first of said chambers including an inlet for the working liquid. The outlet end of each chamber bore is connected by a passageway to the inlet end of the adjacent bore for passing the working liquid from one to the next chamber bore as a fraction of the working liquid is evaporated to cool the remainder.

In the preferred embodiment of the invention described below, all of said passageways connect the upper end of its chamber bore with the lower end of the next chamber bore except that the passageway connecting the next-to-last chamber bore connects to the upper end of the last chamber bore.

According to a further feature in the described preferred embodiment, the common body member is formed with a return channel leading from the bottom of the last chamber bore successively in combination with the other chamber bores to the first chamber bore. In addition, the return channel is connected by a further bore to the bottom of each chamber bore, which further bore is dimensioned to provide the proper flow impedance to regulate the amount of liquid evaporated in the respective chamber bore.

According to a further important feature in the described preferred embodiment, the last chamber bore is formed centrally of the common body member, and the other chamber bores are formed therearound.

Cooling devices constructed in accordance with the foregoing features provide a number of important advantages. One important advantage is the "integrated" construction of the device, analogous to "integrated circuitry" in electronics, as will be described more particularly below. Another important advantage is excellent thermal contact between the $He^3$ liquid and the dilute $He^3$-$He^4$ solution, there being no Kapitza boundary resistance between the liquids. In addition, by directing the incoming $He^3$ liquid from one chamber bore into the bottom of the next chamber bore, i.e., beneath the phase boundary portion of the respective chamber, the $He^3$ liquid enters into the cold $He^3$-$He^4$ solution at the bottom and rises through the cold dilute solution, thereby effecting a good heat transfer between the "evaporated" $He^3$ and the remainder of the working solution; thus, among other benefits, each chamber bore may be of relatively small diameter. Further, forming the chamber bores in a common body member substantially reduces, or entirely eliminates, problems of connection, mechanical supports, and the difficulty of preventing heat leakage, besides enabling such a large number of chambers to be constructed in a simple, inexpensive and compact manner.

Further features and advantages of the invention will be apparent from the description below.

BRIEF DESCRIPTION OF THE DRAWINGS

The invention is herein described, somewhat diagrammatically and by way of example only, with reference to the accompanying drawings, wherein:

FIG. 7 is a bottom view of the mutiple-chamber cooling device of FIG. 6;

FIGS. 8 and 9 are fragmentary views illustrating details of construction of a multiple-chamber cooling device constructed in accordance with FIGS. 6 and 7;

DESCRIPTION OF PREFERRED EMBODIMENTS

Figure 1:
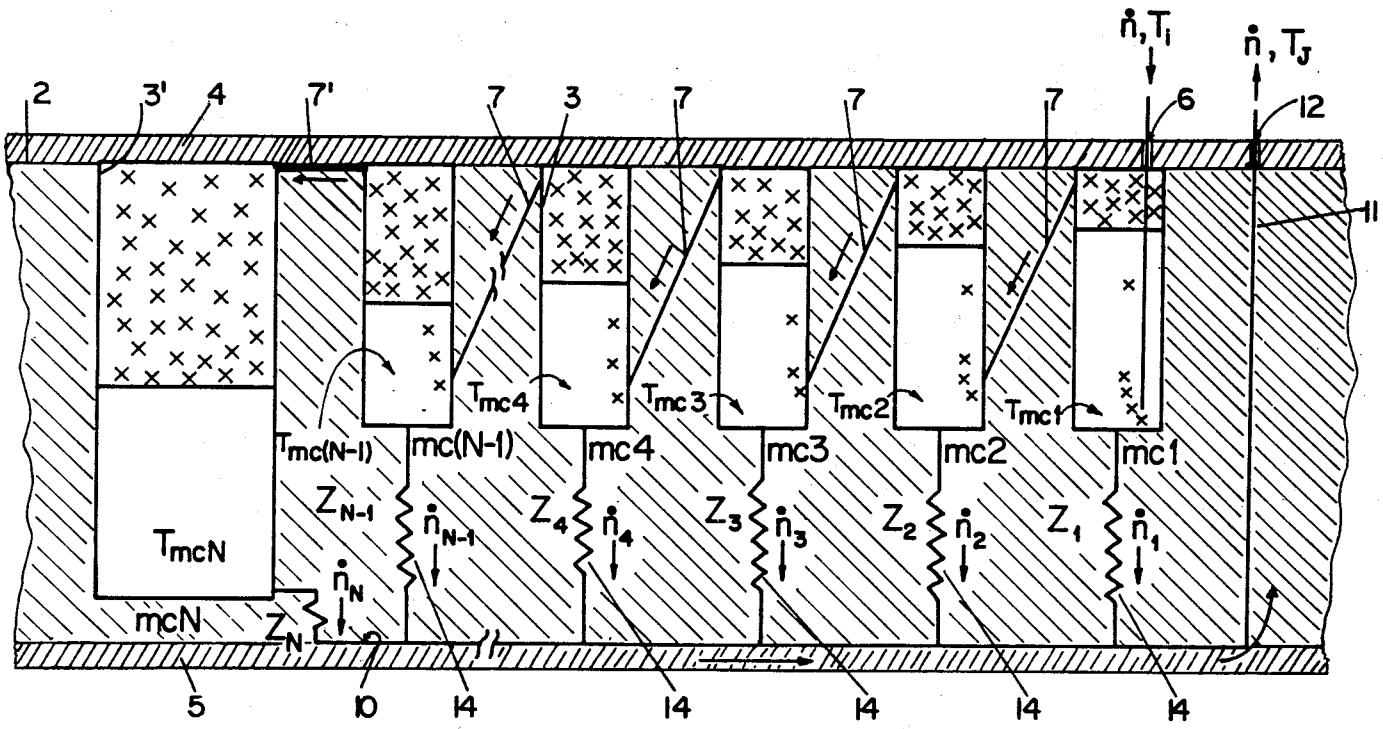
FIG. 1 schematically illustrates one form of multiple chamber cooling device constructed in accordance with the present invention.

With reference to FIG. 1, there is illustrated a common body member, generally designated 2, of a material having low thermal conductivity at the ultra-cold operating temperature of the cooling device, i.e., at a temperature of about one degree within absolute zero. Bores 3 are drilled through one side of the common body member 2 in spaced relationship to each other to define the plurality of mixing chambers, therein designated $MC_1 \ldots MC_N$. In the illustrated arrangement, there are six mixing chambers, the first five being defined by bores 3 of the same diameter and length, e.g., 8 mm diameter and 25 mm length, whereas the last mixing chamber ($MC_N$) is defined by a largerdiameter bore 3' (e.g., 20 mm) of substantially longer length (e.g., 40 mm). A plate 4 is secured over one side of the common body member 2 to close off the upper ends of the chamber bores $MC_1$–$MC_N$, and a second plate 5 is secured to the opposite side of the common body member.

Plate 4 is formed with a small bore 6 to provide an inlet for the working liquid into the first chamber bore $MC_1$. Further bores 7 are formed between the chamber bores to define passageways connecting the upper end of each bore to the lower end of the next adjacent bore, except that in the case of the next-to-last bore $MC_{N-1}$, this connecting bore 7' defines a passageway from the upper end of that bore to the upper end of the last chamber bore $MC_N$.

In addition, the common body member 2 is formed on its opposite face, i.e., the face adjacent to plate 5, with a return channel, schematically designated 10, leading from the bottom of the last chamber bore $MC_N$ and underlying all the other chamber bores. This return channel 10 leads to a further bore, schematically indicated at 11 in FIG. 1, through the common body member 2, and a further bore 12 in plate 4, for the return of the "spent" working fluid from the last chamber $MC_N$. The return channel 10 is coupled to the bottom of each chamber bore by a further bore, schematically indicated at 14, each such further bore being dimensioned to provide the proper flow impedance to regulate the amount of liquid evaporated in the respective bore. For this reason, this further bore 14 is indicated by the impedance symbol $Z_1 \ldots Z_N$; the impedance of the bore determines the flow ($\dot{n}$) from the bottom of the respective chamber bore to the return channel 10.

Figure 2:
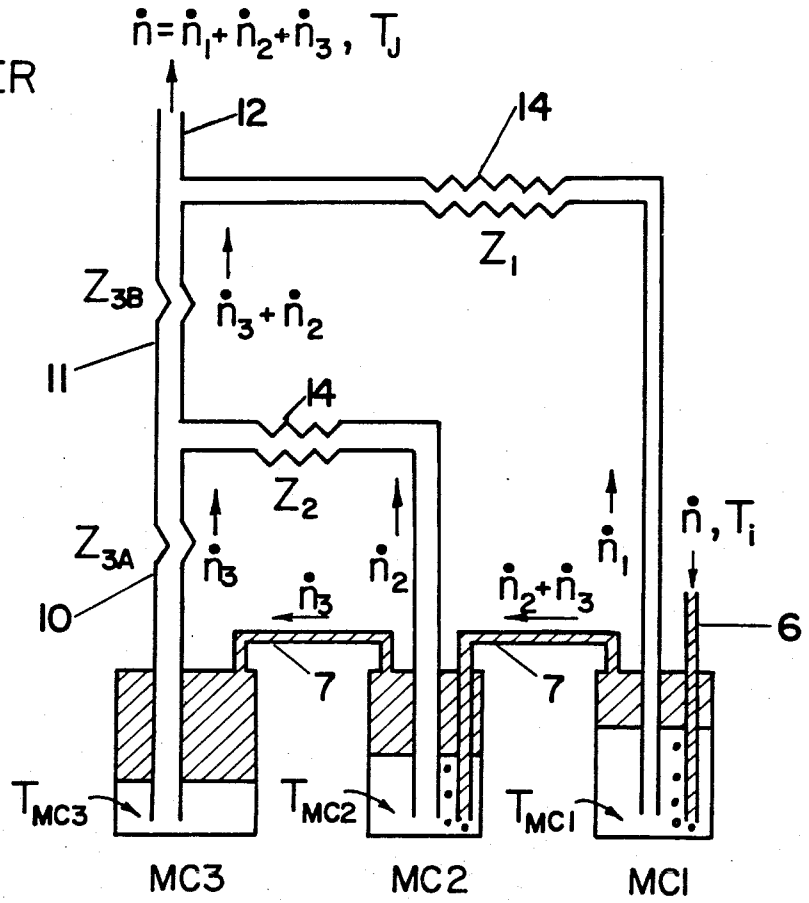
FIG. 2 schematically illustrates the flow impedances involved in a three-chamber cooling device constructed in accordance with FIG. 1.

FIG. 2 schematically illustrates the operation of a three-chamber cooling device constructed as described above with respect to FIG. 1, and provides a table of the impedances (Z) which have been determined experimentally. As described above, these impedances Z depend on the dimensions of the bores (14 in FIG. 1) which connect the bottoms of the chambers to the return channel 10, and which thereby determine how much $He^3$ is evaporated in each mixing chamber.

The device illustrated in FIG. 1 operates as follows: The starting liquid, namely a mixture of the isotopes $He^3$ and $He^4$, is introduced via inlet 6 into the first chamber bore $MC_1$ at an ultra-low temperature, i.e. within 1/2 degree of absolute zero. At this temperature, the starting liquid separates into an upper $He^3$-rich (concentrated) phase of practically pure $He^3$, and a lower $He^4$-rich (dilute) phase of superfluid $He^4$ which has, below 0.1° K, over 6% $He^3$ dissolved therein. A fraction of the $He^3$ present in the $He^3$ working liquid is forced to "evaporate" in each chamber, thereby cooling the remaining $He^3$ working liquid, until the working liquid reaches the last chamber ($MC_N$), wherein it evaporates completely.

The $He^3$ is circulated in a closed cycle. As long as the precooled $He^3$ liquid is introduced continuously via inlet 6 into $MC_1$, this device will provide continuous cooling. If the introduction of precooled $He^3$ liquid to $MC_1$ is terminated, then the cooling will shortly terminate as the $He^3$ liquid in each mixing chamber is exhausted. The $He^4$ liquid in each mixing chamber plays the role of a static "inert ether" or "invisible supporting liquid" since at these very low temperatures, its physical properties resemble those of a vacuum. Thus, when the $He^3$ liquid is "evaporated" or diluted into the $He^4$ *liquid, the He³* particles behave as a nearly ideal Fermi gas. This cold gas is forced to diffuse through the $He^4$ liquid through heat exchangers (which precooled the warm $He^3$ incoming liquid) until this dilute gas reaches the "still" or distillator, a device which preferentially evaporates the $He^3$ from the dilute $He^3$–$He^4$ solution into the $He^3$ gaseous state. The distillation of the $He^3$ is achieved through the simultaneous application of heat to the "still" and application of vacuum pumping upon the "still". The amount of heat dissipated in the "still" determines the $He^3$ circulation rate and directly influences the amount of cooling produced by this device. The "still" typically operates at a temperature of 0.5 K to 0.75 K. The $He^3$ gas is returned in a closed cycle where it is cooled to 4 K in a liquid $He^4$ bath, then cooled and liquified at a 1.5 K cooling stage, and then precooled to 0.75 K at the "still", and finally precooled to about 30 mK through the use of heat exchangers, at which point it is introduced into It will be seen that the working fluid is fed, via the connecting passageways 7, from the top of each chamber to the bottom of the next succeeding chamber, except for the last chamber $MC_N$. Thus, the incoming $He^3$ liquid is introduced into each chamber beneath the phase boundary portion so that the $He^3$ liquid enters the cold $He^3$–$He^4$ solution at the bottom and rises through it; as the $He^3$ evaporates, it cools the dilute solution. Thus, direct contact heat exchange is effected between the two fractions, permitting the use of very small diameter bores for each mixing chamber. In the case of the last mixing chamber $MC_N$, however, it is preferred to introduce the working fluid into the top, rather than the bottom, of the chamber, since this mixing chamber would normally hold the sample to be cooled, which sample might interfere with the rising $He^3$ droplets.

Figure 3:
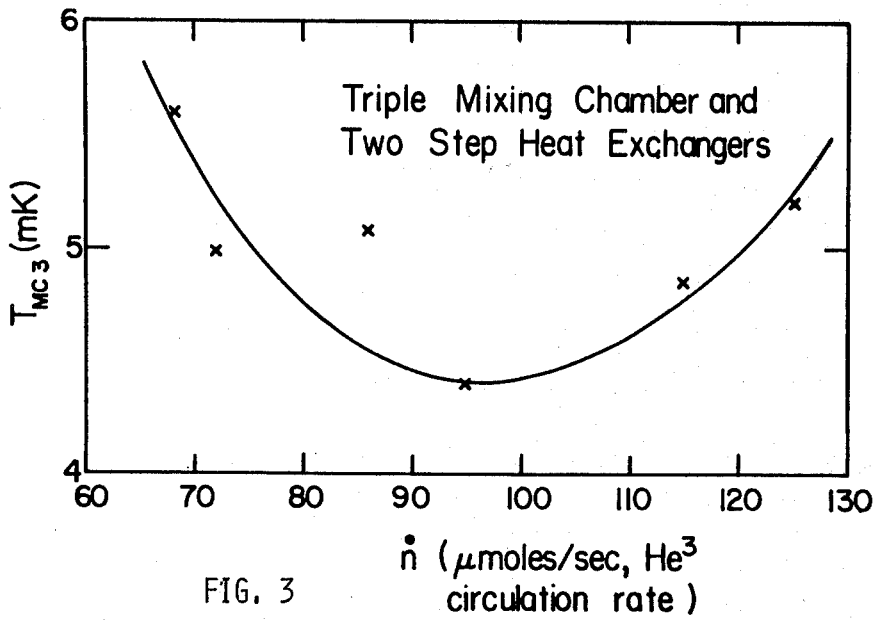
FIG. 3 is a curve illustrating the minimum temperature obtained in the third mixing chamber of a three-chamber device constructed in accordance with FIG. 2.

FIG. 3 illustrates the minimum temperature obtained in the third mixing chamber, using a three-chamber cooling device, as a function of the $He^3$ circulation rate. These results were obtained experimentally despite the presence of a troublesome superfluid leak, and therefore are considered to be amazingly good. No heat was applied to the last mixing chamber $MC_3$.

Figure 4:
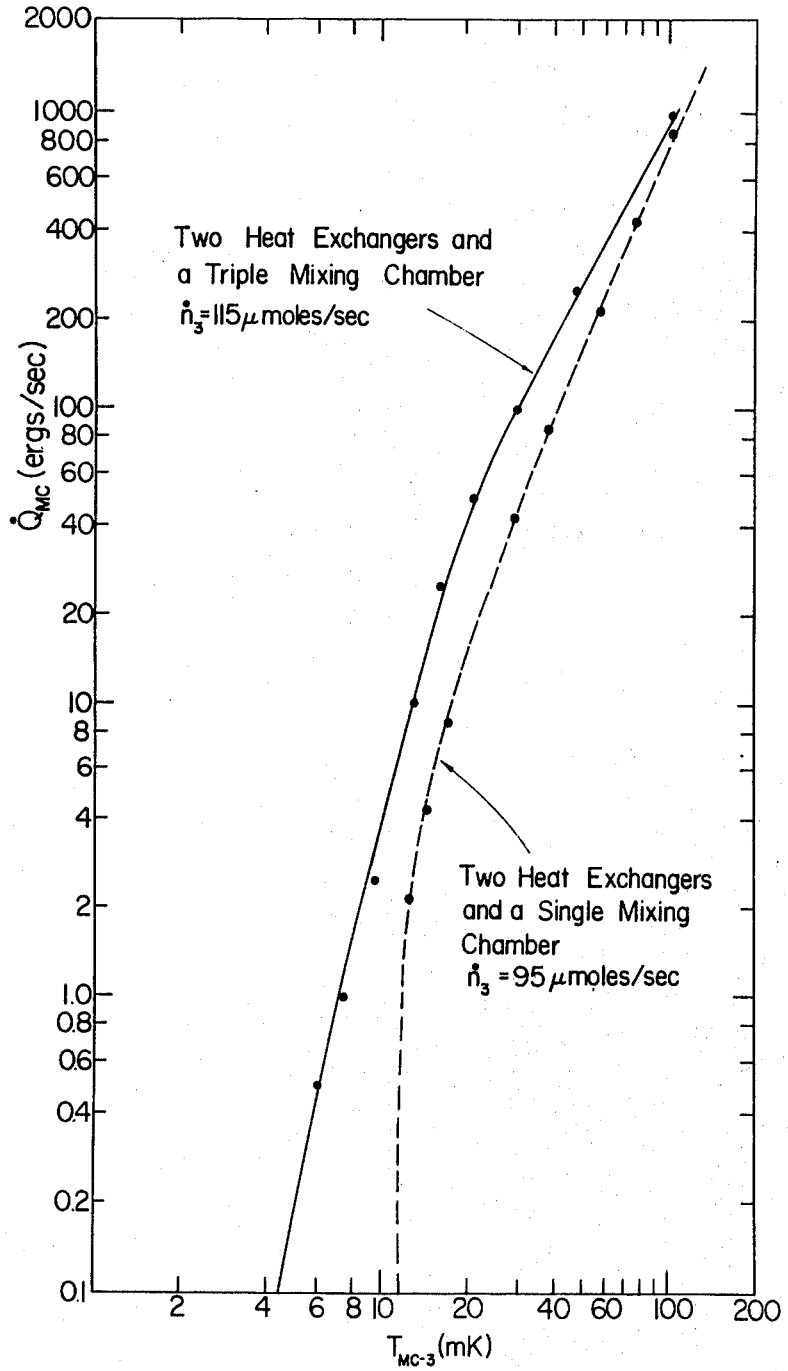
FIG. 4 illustrates, in full lines, the cooling curve of the third chamber in a three-chamber device as a function of the external heat applied to its face, and in broken lines, the corresponding cooling curve in a single-chamber cooling device.

FIG. 4 illustrates comparative cooling curves as a function of external heat applied to the base of the cooling device. Thus, the full line cooling curve in FIG. 4 was obtained when using two heat-exchangers and a triple mixing chamber cooling device, wherein the flow rate ($\dot{n}_3$) was 115 $\mu$ moles/sec; whereas the broken line curve in FIG. 4 illustrates the cooling curve when using two heat-exchangers and a singel mixing chamber having a flow rate ($\dot{n}_3$) equal to 95 $\mu$ moles/sec.

Figure 5:
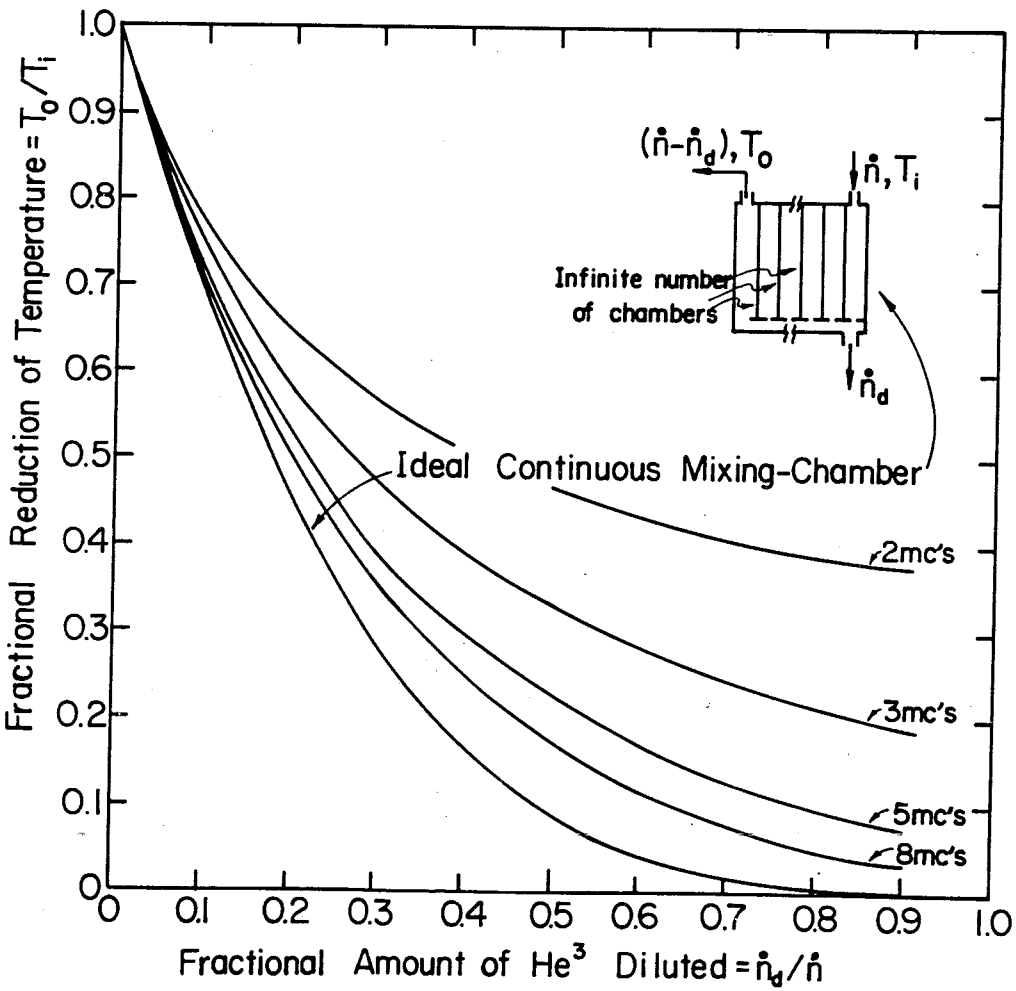
FIG. 5 curves illustrate the theoretical temperature of the outgoing $He^3$ liquid from the next-to-the-last mixing chamber in a plural-chamber device constructed in accordance with FIG. 1, in the absence of heat leaks.

FIG. 5 illustrates the theoretical temperature of the outgoing $He^3$ liquid from the next-to-last mixing chamber in a cooling device having an infinite number of chambers. These are theoretical predictions and ignore heat leaks in their calculations; experimental results are greater by a factor of two because of heat leaks. A factor of two or more reduction in temperature will also be realized in the last mixing chamber. It will be noted that the theoretical predictions illustrated in FIG. 5 suggest the use of five to eight mixing chambers.

As indicated above, the common body member 2 must be of a material having a low thermal conductivity at the operating temperature of the cooling device, i.e., below one degree K. The common body member 2 should also be easily machinable to conveniently provide the bores, channels and passageways discussed above. One material that may be used is a non-magnetic epoxy resin, such as Epibond 100A or Stycast 1266, which has the further advantage that it can be easily bonded to the plates 4 and 5 to close off the mixing chambers and channels, as described above, which plates may be made of the same epoxy material. Most epoxy resins have a very low thermal conductivity, but even if the thermal conductivity is relatively high, very little heat will be transferred to the walls of the body member because of the Kapitza boundary resistance which exists between the liquid and any solid below 30 mK. Thus, the previously-troublesome Kapitza boundary resistance is used, in the present invention, to advantage in order to thermally isolate each mixing chamber from its neighbors.

The common body member 2, however, can also be made of a metal which becomes a superconductor at the ultra-cold operating temperature of the cooling device, since superconducting metals lose their thermal conductivity below 0.1 K and conduct heat very poorly. One example of such a metal is aluminum, which goes superconducting at 1.2 K and is used a heat switch below 0.1 K because of its very low thermal conductivity. Aluminum is also easily machinable, and seals to indium O-rings. However, aluminum has two disadvantages, namely: all parts must be heli-arc welded or epoxied, since aluminum does not accept silver solder or soft solder; also, aluminum has a critical magnetic field of 105 Gauss, which means that it will convert to a normal metal of high thermal conductivity in the presence of a magnetic field greater than 105 Gauss. This last problem can be circumvented by shielding the mixing chamber from a fringing magnetic field by enclosing it inside a superconducting shield of niobium, for example.

Another example of a metal which becomes superconducting at the ultra-cold operating temperature of the present cooling device, and which therefore may be used as the common body member 2, is a brass alloy, which has 40% zinc, 2% lead, and the remainder of copper. We have observed that this brass alloy goes superconducting at 0.3 K, but none of its physical properties have been measured below 0.3 K. Brass is attractive since it is easily machinable and accepts soft and silver solders.

Figure 6:
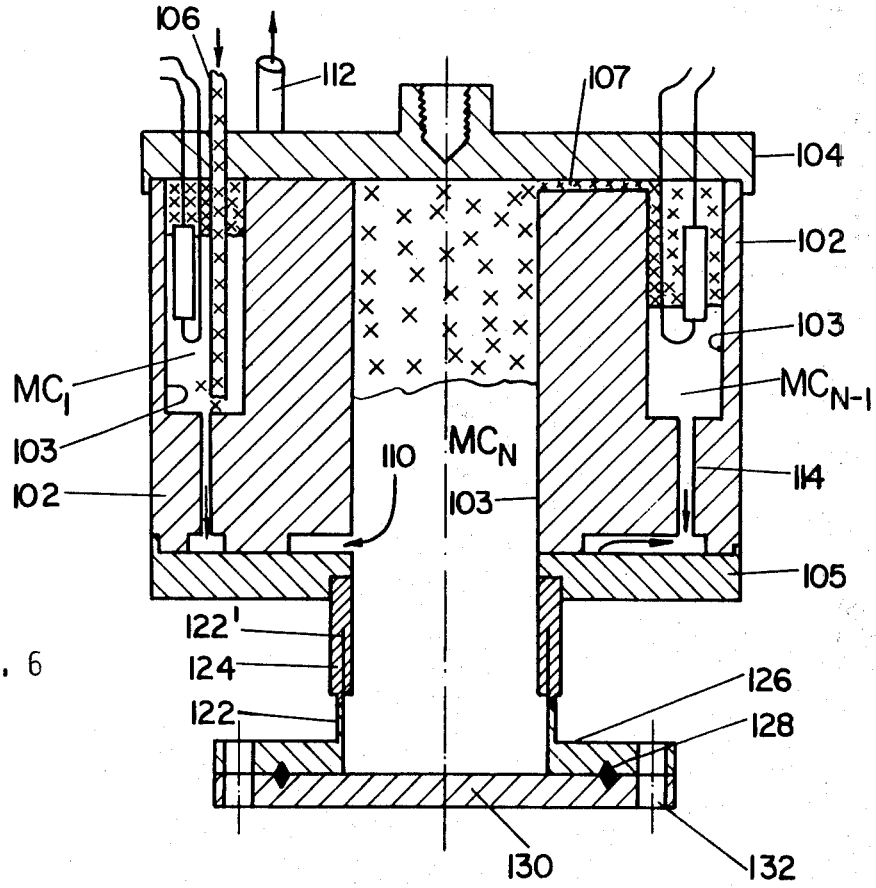
FIG. 6 is a cross-sectional view of another multiple-chamber cooling device constructed in accordance with the present invention.

FIGS. 6 and 7 illustrate another construction of multiple-chamber cooling device in accordance with the present invention, in which the last chamber is formed centrally of the common body member, and the bores defining the other chambers are formed around it. More particularly, the cooling device illustrated in FIGS. 6 and 7 is constructed in the following manner:

A body member 102 of an epoxy resin (alternatively, aluminum or brass as briefly discussed above) of about 70 mm diameter, is cut to a length of 45 mm. A bore 103' of about 25 mm diameter is formed centrally through it to define the last mixing chamber $MC_N$. Bores 103 of 8 mm diameter are drilled from one face of the common body member 102 to a depth of about 25 mm, to define all the remaining mixing chambers, i.e. $MC_1$-$MC_{N-1}$. As shown particularly in FIG. 7, there are seven of such bores 103, spaced 45° from one another on an outer diameter of approximately 48 mm. In this arrangement, there is approximately 11–12 mm material separation between the walls of two neighboring mixing chambers. This is shown by the dimension "S" in FIG. 8. Small bores 107, each of a length "l", are formed through the separating walls to define passageways connecting the upper end of one mixing chamber with the lower end of the next mixing chamber.

As shown in FIG. 7 illustrating the bottom face of the common body member 102, this bottom face is formed with the return channel 110, corresponding to channel 10 in FIG. 1, which returns the "spent" working fluid from all the mixing chambers to the outlet 112, corresponding to bore 12 in FIG. 1. In the arrangement illustrated in FIG. 7, however, this return channel includes two circular segments **110*a* and 110*b*. Segment 110*a* leads from the bottom of the last mixing chamber $MC_N$ (bore 103') and extends for approximately 300°, and then makes a U-turn wherein it joins with circular channel segment 110*b*, the latter channel segment underlying all the other mixing chambers, and leading to bore 112 formed through the common body member 102 and defining the outlet port for the "spent" working liquid. Further bores 114 are formed connecting the return channel segment 110*b* with each of the bores 103 defining the mixing chambers $MC_1$ to $MC_{N-1}$. As described earlier, these further bores 114 are dimensioned so as to provide the proper flow impedances of each mixing chamber in order to regulate the amount of liquid "evaporated" in each. As one example, bores 114** may have a length of about 17 mm and a diameter of 0.5–0.8 mm, to yield flow impedance values of $10^6$ to $10^7$ $cm^{-3}$; these values would provide proper operation of the device wherein $Z=(128/\pi)L/d^4$.

As one example, the bores 107 connecting the top of each mixing chamber to the bottom of the next adjacent chamber (except for the last chamber) may be of approximately 1.2 mm diameter, making an angle of approximately 65° with the top surface, as shown particularly in FIG. 8. When the separation wall (S) is 12 mm between the mixing chambers, each bore 107 will have a length (l) of 2 cm before penetrating into the bottom of the next adjacent chamber. This separation is required to minimize thermal conduction of the $He^3$ liquid between the two mixing chambers.

Fig. 9 illustrates a modification to enable the density of the mixing chambers to be substantially increased (e.g., doubled) at the expense of decreasing the thickness of the separation wall (S) to a few mm between mixing chambers. In this case, a hole drilled between adjacent chambers may produce a thermal short. However, this can be avoided by the use of flexible plastic tubes 107' for the passageways interconnecting the mixing chambers. Thus, the upper end of each tube 107' is inserted into a bore formed through the separation wall, with the lower end of the tube extending to the bottom of the adjacent mixing chamber. Tubes 107' may also be of an epoxy plastic and may be bonded in the bore of the separation wall by an epoxy resin. Because of the poor thermal conductivity of this plastic, and because of the Kapitza boundary resistance, the $He^3$ liquid in the tube is thermally isolated from the liquid outside the tube. Thus, thermal isolation can be achieved between adjacent mixing chambers even though their separation is as little as 1 mm. By using the construction illustrated in FIG. 9, as many as 20 or 30 mixing chambers may be incorporated in a single common body member 102.

As indicated earlier, the common body member 102 may be made of an epoxy resin, or of a metal, such as aluminum or brass, having a low thermal conductivity at the ultra-cold operating temperature of the device. Such cooling devices preferably include a removable flanged plate to provide access to the last mixing chamber for insertion of the sample to be cooled, and one of the problems in using an epoxy plastic for the body member is the difficulty of effecting a seal between it and the flanged plate. Epoxy plastics do not seal to soft metal "O" rings because of the large contraction difference between the plastic and the metal; thus, if an epoxy rod is cast upon a metal tube of sizeable diameter (10 mm or greater), it will generally shatter at low temperatures.

To solve this problem, the arrangement illustrated in FIG. 6 includes a special epoxy-to-metal seal, made by "feathering" or machining down a copper tube 122 to a very thin-wall thickness 122' of 0.1 mm for a length of about 1 cm. Epoxy plastic 124 is then cast over this thin-wall portion 122' of the copper tube and is bonded to the bottom plate 105, which is also of the epoxy plastic.

Copper is a soft metal, and when it is machined down to the thin tube section 122' over which the epoxy plastic 124 is cast, this thin tube section becomes flexible and distorts according to the contraction of the epoxy tube 124 cast over it. The copper tube 122 may then be provided with the attaching flange 126 for attaching same, via the indium-ring seal 128, to the removable plate 130, also of copper, which plate is removable by fasteners received in openings 132, to provide access to the interior of the last mixing chamber.

Preferably, very small holes (not shown), e.g. 1 mm, may be drilled into the feathered section 122' of the copper tube 122 to permit the epoxy plastic to penetrate through the holes and become firmly bonded to the copper tube. Such a seal construction has been successfully thermally cycled without producing leaks or shattering.

It will thus be seen that the technique described above, of "integrating" the mixing chambers in a single block of material, is analogous to the "integrated-circuit" technique widely used at the present time in producing highly-sophisticated electronic circuitry, wherein thousands of transistors, resistors and connecting leads are applied to a common semiconductor substrate. Thus, our "substrate" is constituted by the common body member (2 or 102) of very low thermal conductivity. The mixing chambers in the described construction defined by the bores (3 or 103) formed through the common body member correspond to the transistors and other electrical components in the electrical integrated circuit; the return channel (10 or 110) formed in the bottom of the common body member corresponds to the electrical leads connecting the transistors to the voltage supply in the integrated circuit; the small-diameter bores defining the passageways (7 or 107) between adjacent mixing chambers correspond to the electrical connections between transistors in the integrated circuit; and the small-diameter bores (14 or 114) connecting the return channel to the bottoms of the mixing chambers, to provide the proper flow impedance and thereby to regulate the amount of $He^3$ evaporated in each mixing chamber, correspond to the resistors or other impedances in the electronic integrated circuit.

Figure 10:
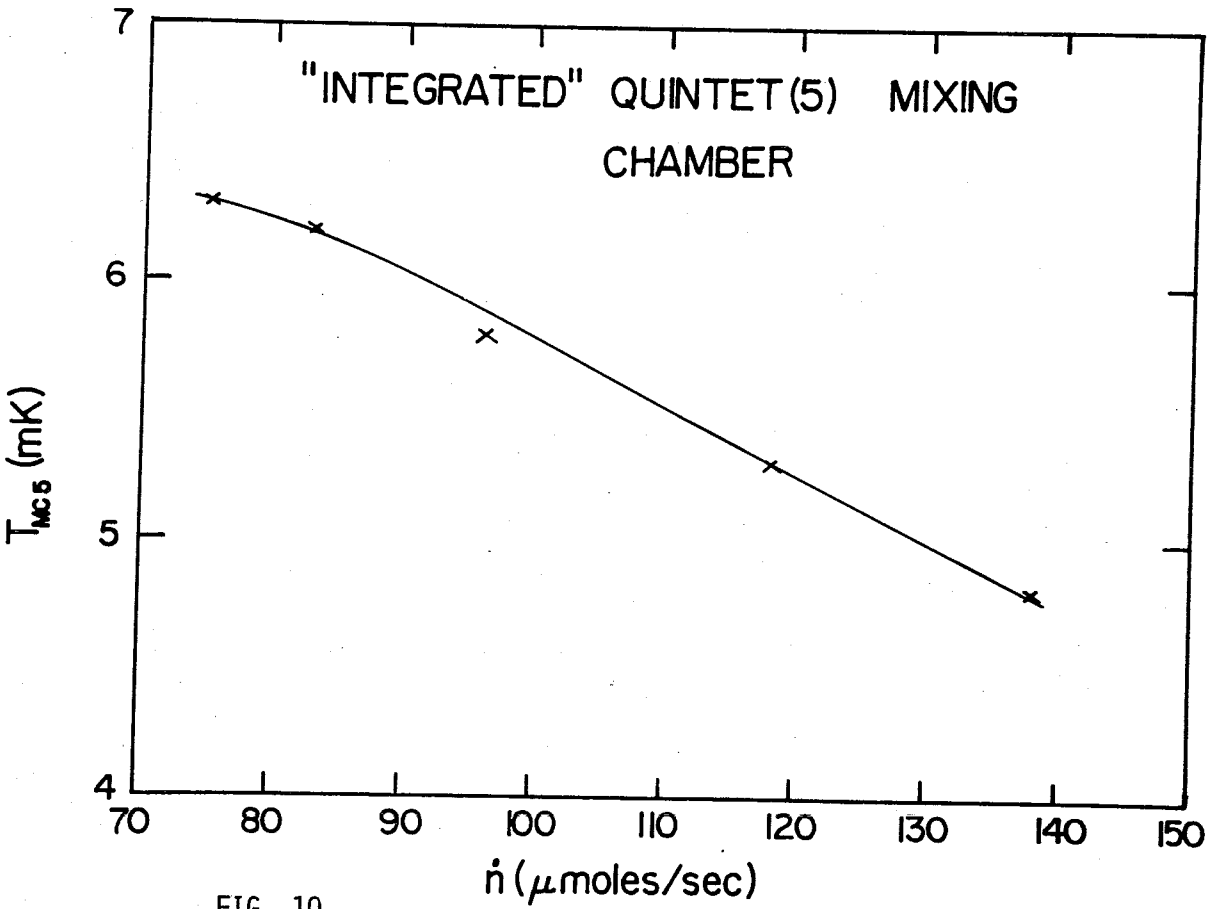
FIG. 10 is a curve illustrating initial experimental results obtained with respect to the minimum temperature in the fifth mixing chamber of a five-chamber device constructed in accordance with FIGS. 6 and 7, as a function of the $He^3$ circulation rate.
Figure 11:
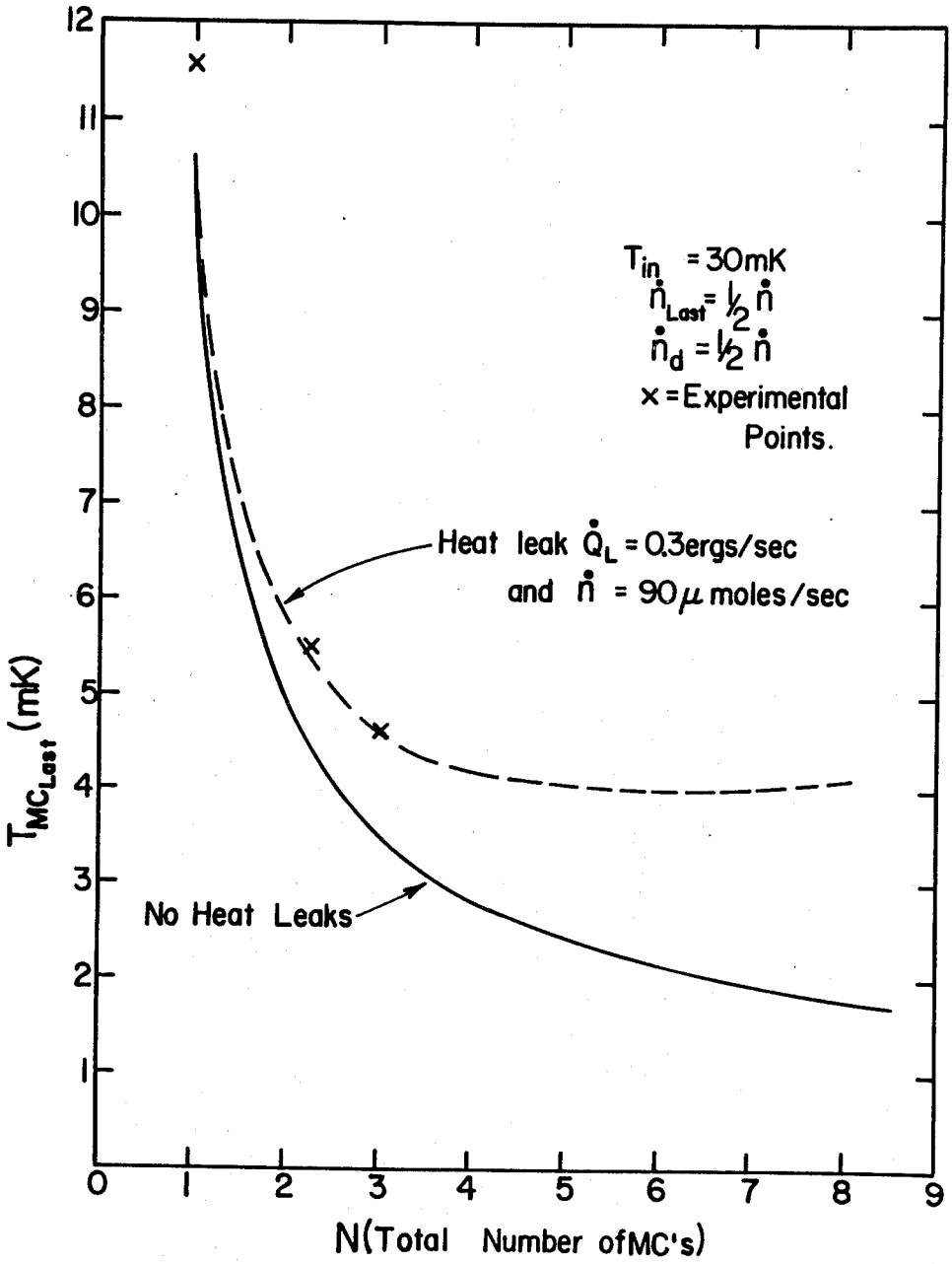
FIG. 11 presents curve illustrating theoretical predicted temperatures of the last mixing chamber as a function of the number of mixing chambers, in a multiple-chamber device constructed in accordance with FIGS. 6 and 7, these predicted temperatures assuming the presence of a heat leak ($\dot{Q}_L$) equal to 0.3 ergs/sec which is absorbed by each mixing chamber.

As shown in FIG. 10, the lower temperature in the last chamber of a 5-chamber cooling device was obtained by circulating the maximum $He^3$. This was considered to be somewhat startling, since in all earlier experiments, a minimum temperature around 90 μmol/-sec circulation $He^3$ rate was observed. The minimum temperature occurs at this rate since the heat-exchangers still have sufficient surface area to cool this flow of $He^3$, and this flow gives the highest refrigeration to overcome the heat leaks in the refrigerator. At faster circulation rates, there is not enough surface area in the heat-exchangers to cool the warm $He^3$ liquid, and the temperature thus increases. However, in the multiple mixing chamber configuration, each chamber removes some of the incoming $He^3$ liquid, leaving less liquid to be evaporated in the last chamber. It now appears that by increasing the rate of liquid circulated, this will increase the rate of the liquid entering the last chamber to produce greater cooling and lower temperatures. The heat-exchangers have little influence on the final temperatures for different circulation rates.

While the invention has been described with respect to certain preferred embodiments, it will be appreciated that many variations, modifications and other applications of the invention may be made.

What is claimed is:

1. A multiple-chamber cooling device particularly useful in a dilution refrigerator in which a working liquid is passed successively through a plurality of chambers in each of which a fraction of the working liquid is allowed to evaporate to cool the remaining working liquid, characterized in that said cooling device comprises a common body member of a material having low thermal conductivity at the operating temperature of the cooling device; said common body member being formed with a plurality of spaced bores each defining one of said chambers and having an inlet end and an outlet end; the bore defining the first of said chambers including an inlet for the working liquid; the outlet end of each chamber bore being connected by a passageway to the inlet end of the adjacent bore for passing the working liquid from one to the next chamber bore as a fraction of the working liquid is evaporated to cool the remainder.

2. The cooling device according to claim 1, wherein the bores extend vertically, and at least some of said passageways connect the upper end of each chamber bore with the lower end of the adjacent chamber bore so that in each chamber bore the evaporated fraction of the working liquid rises through the remainder of the working liquid in the respective chamber bore.

3. The cooling device according to claim 2, wherein all said passageways connect the upper end of its chamber bore with the lower end of the next chamber bore except that the passageway connecting the next-to-last chamber bore connects to the upper end of the last chamber bore.

4. The cooling device according to claim 2, wherein said connecting passageways are defined by inclined bores formed through said common body member.

5. The cooling device according to claim 2, wherein said passageways are defined by tubular members having an inlet end inserted into further bores formed in said common body member between adjacent chamber bores, and having an outlet end at the bottom of the adjacent chamber bore.

6. The cooling device according to claim 1, wherein the common body member is formed with a return channel leading from the bottom of the last chamber bore successively in communication with the other chamber bores to the first chamber bore.

7. The cooling device according to claim 6, wherein said return channel is connected by a further bore to the bottom of each chamber bore, which further bore is dimensioned to provide the proper flow impedance to regulate the amount of liquid evaporated in the respective chamber bore.

8. The cooling device according to claim 1, wherein the last chamber bore is formed centrally of the common body member, and the other chamber bores are formed therearound.

9. The cooling device according to claim 8, wherein said return channel includes an outer circular segment leading from the last chamber bore and underlying the other chamber bores, and a connecting inner circular segment between said outer circular segment and the last chamber bore to minimize heat leakage to the last chamber bore.

10. The cooling device according to claim 9, further including a top plate fixed to one side of said common body member to close off all said chamber bores, and a bottom plate fixed to the bottom of said common body member closing off said return channel.

11. The cooling device according to claim 10, wherein said bottom plate includes, in alignment with said last chamber bore, a flange sealingly coupled to a cover plate which is removable in order to facilitate access within said last chamber bore.

12. The cooling device according to claim 1, wherein the working liquid is a starting liquid mixture of the isotopes $He^3$ and $He^4$, which liquid mixture, at ultra-low temperatures, separates into a $He^3$-rich phase (concentrated phase) of practically pure $He^3$, and a $He^4$-rich phase (dilute phase) of superfluid $He^4$ having somewhat over 6% $He^3$ which is forced to cross the phase boundary from the concentrated phase at the top to the dilute phase at the bottom to effect the cooling of the working liquid in the respective chamber bore.

* * * * *